US007619175B2

(12) United States Patent
Obara

(10) Patent No.: US 7,619,175 B2
(45) Date of Patent: Nov. 17, 2009

(54) SPRING STRUCTURE FOR PRESS TYPE SWITCH AND PRESS TYPE SWITCH FOR ELECTRONIC TIMEPIECE AND ELECTRONIC TIMEPIECE HAVING THE SAME

(75) Inventor: Kazumichi Obara, Chiba (JP)

(73) Assignee: Seiko Instruments Inc. (JP)

( * ) Notice: Subject to any disclaimer, the term of this patent is extended or adjusted under 35 U.S.C. 154(b) by 97 days.

(21) Appl. No.: 12/011,973

(22) Filed: Jan. 30, 2008

(65) Prior Publication Data

US 2008/0197006 A1 Aug. 21, 2008

(51) Int. Cl.
*H01H 3/12* (2006.01)

(52) U.S. Cl. ..... 200/341; 200/345

(58) Field of Classification Search ..... 200/310–315, 200/341–345

See application file for complete search history.

(56) References Cited

U.S. PATENT DOCUMENTS 4,011,422 A * 3/1977 Sanford et al. ..... 200/276.1
7,312,789 B2 * 12/2007 Koike et al. ..... 345/163

FOREIGN PATENT DOCUMENTS

JP 2002077678 3/1990
JP 59091632 6/1994

* cited by examiner

*Primary Examiner*—Michael A Friedhofer
*Assistant Examiner*—Lisa N Klaus
(74) *Attorney, Agent, or Firm*—Adams & Wilks

(57) ABSTRACT

To provide a spring structure for a press type switch and a press type switch of an electronic timepiece capable of minimizing a variation among products with regard to a click feeling and an electronic timepiece having the same. A spring structure for a press type switch of an electronic timepiece includes a base portion fixed to a stationary supporter of the timepiece, a click feeling forming arm including first elastic arm portions extended from first base end portions integral with the base portion and capable of being deformed to bend elastically and first engaging projected portions formed at one sides of the first front end portions of the first elastic arm portions, and a press arm including second elastic arm portions extended to bend in an arc-like shape from second base end portions integral with the base portion and capable of being deformed to bend, a pressing projected portion projected to the first front end portion at a position of the second elastic arm portion opposed to the first front end portion of the click feeling forming arm and second engaging projected portions capable of being engaged with and disengaged from the first engaging projected portions.

20 Claims, 4 Drawing Sheets

SPRING STRUCTURE FOR PRESS TYPE SWITCH AND PRESS TYPE SWITCH FOR ELECTRONIC TIMEPIECE AND ELECTRONIC TIMEPIECE HAVING THE SAME

BACKGROUND OF THE INVENTION

1. Field of the Invention

The present invention relates to a spring structure for a press type switch and a press type switch suitable for being used in an electronic timepiece such as a wristwatch and an electronic timepiece having the same.

2. Description of the Related Art

In a small-sized electronic timepiece such as a wristwatch, it is known that a click feeling can be provided in accordance with pressing a press button such that a user can actually feel an operation of a pres type switch operated in accordance with pressing the press button (for example, Microfilm of Japanese Utility Model Application No. 57-188151 (JP-UM-A-59-91632) (for example, FIG. 4 and a related explanatory portion thereof) and JP-B-7-104418 (for example, FIG. 25 and a related explanatory portion thereof)).

According to a press type switch of the type proposed in the background art, in order to provide the click feeling, a spring of a mode of a large U shape lever is used. The U shape lever spring is provided with a recess portion totally pivoted or rocked around a pivoting shaft in accordance with pressing the press button and engaged with and disengaged from a pin projected from a main plate or the like at a front end portion of a front end side leg portion of U.

According to the press button switch of the background art of the type of combining the U shape lever and the pin, in order to be able to provide a desired click feeling, a high dimensional accuracy is requested for relative positions and relative directions of a plurality of parts such that not only a high accuracy is requested for a shape of the U shape lever spring but particularly, a high positional accuracy or the like is requested also for the pivoting shaft and the engaging and disengaging pin for generating the click feeling.

As a result, it is not easy to minimize a variation among individuals of products to provide a pertinent click feeling.

SUMMARY OF THE INVENTION

It is an aspect of the present invention to provide a spring structure for a press type switch and a press type switch of an electronic timepiece capable of minimizing a variation among products with regard to a click feeling as well as an electronic timepiece having the same.

In order to achieve the above-described aspect, a spring structure for a press type switch of an electronic timepiece of the invention is a spring structure for a press type switch of an electronic timepiece, the spring structure including a base portion fixed to a stationary supporter of the electronic timepiece, a click feeling forming arm including one first elastic arm portion extended from one first base end portion formed integrally with the base portion and capable of being deformed to bend elastically and one first engaging projected portion formed on one side of a first front end portion of the first elastic arm portion, and a press arm including one second elastic arm portion extended to bend in an arc-like shape from one second base end portion formed integrally with the base portion and capable of being deformed to bend, a pressing projected portion projected to the first front end portion at a position of the one second elastic arm portion opposed to the first front end portion of the one first elastic arm portion of the click feeling forming arm and one second engaging projected portion engageable with and disengageable from the one first engaging projected portion at a side edge on a side of a projected end portion of the pressing projected portion opposed to the one first engaging projected portion of the click feeling forming arm, wherein when the pressing projected portion of the press arm is pressed, the one second engaging projected portion of the pressing projected portion of the press arm is engaged with the one first engaging projected portion of the click feeling forming arm to elastically bend the one first elastic arm portion by pressing the one first engaging projected portion in a lateral direction, and an engagement with the one first engaging projected portion is constituted to be released by passing a location, of the one first engaging projected portion.

According to the spring structure for a press type switch of the invention, "when the pressing projected portion of the press arm is pressed, the one second engaging projected portion of the pressing projected portion of the press arm is engaged with the one first engaging projected portion of the click feeling forming arm to elastically bend the one first elastic arm portion of the click feeling forming arm by pressing the one first engaging projected portion in the lateral direction and is released from an engagement with the one first engaging projected portion by passing the location of the one first engaging projected portion", and therefore, the engagement and disengagement of the one first and second engaging projected portion can provide a click feeling.

Further, according to the spring structure for a press type switch of the invention, particularly, both of the press arm and the click feeling forming arm are integrally formed with the base portion at respective one base end portions, a total of the spring structure is formed by an integrated member, and therefore, the click feeling can stably be provided by only fabricating highly accurately a dimension and a shape of a single part constituting the spring structure for the press type switch, and therefore, a variation among products with regard to the click feeling can easily be minimized. Further, it is useful for reducing cost that the part per se comprises a single part or a single member.

Here, an accuracy of planar shape and dimension is only requested actually for the base portion, the press arm and the click feeling forming arm through the total of the spring structure for the press type switch, and therefore, the spring structure for the press type switch of the invention may be fabricated by any fabricating means capable of realizing a two-dimensional shape by desired size and accuracy. That is, in fabricating the spring structure for the press type switch of the invention, preferably, there is used MEMS (Micro Electro Mechanical System) in a wide sense as a micro machine technology utilizing, for example, a semiconductor integrated circuit technology. Further, in this case, a material constituting an object of MEMS is a material having spring performance and is typically a metal material. However, when a dimensional accuracy can easily be ensured (for example, punching can be carried out such that an influence of a roughness of a face of a punched portion effected on the click feeling falls in an allowable range, or working at low cost is easy), a technology of forming a plate-like structure of a background art of punching by a punch die or the like may be used. Further, although the spring structure for the press type switch of the invention comprises typically, a metal having a spring performance, when desired, the spring structure may comprise a material of a resin or the like.

When the spring structure for the press type switch of the invention is used as a spring for a side switch of an electronic timepiece such as a wristwatch, sizes in respective vertical and horizontal directions of the spring structure expanded two-dimensionally are typically, to a degree of a thickness of the main plate (that is, typically, about several mm), and a thickness thereof is typically in an order of 0.1 mm. However, the both may be larger or smaller.

According to the spring structure for the press type switch of the invention, typically, the one first elastic arm portion of the click feeling forming arm is extended skewedly to a direction of displacing the pressing projected portion of the press arm such that the more on the front side, the more proximate to a path of displacing the pressing projected portion of the press arm.

In this case, even when the one first elastic arm portion of the click feeling forming arm is comparatively slender, a comparatively large elastic force can be exerted, further, after releasing the engagement with the first engaging projected portion of the click feeling forming arm, there is a less concern that the second engaging projected portion interferes with the first elastic arm portion of the click feeling forming arm.

According to the spring structure for the press type switch of the invention, typically, the one second base end portion of the one second arm portion of the press arm is formed integrally with the base portion on one side of the base portion, and wherein the press arm further includes other second elastic arm portion extended to bend in an arc-like shape from other second base end portion integrally formed with other side of the base portion and capable of being deformed to bend, and the other second elastic arm portion is integrally connected to the pressing projected portion at an extended end thereof to thereby support the pressing projected portion elastically at both sides thereof in cooperation with the one second elastic arm portion.

In this case, the pressing projected portion of the press arm is supported at both sides thereof by the pair of second elastic arm portions, that is, the one and other second elastic arm portions, and therefore, even when the second elastic arm portion is comparatively slender, the direction of displacing the press arm portion of the press arm is stably rectified, typically, is easy to be set linearly. Further, after finishing pressing, the press arm can be returned to the original position by a comparatively strong recovery force.

According to the spring structure for the press type switch of the invention, typically, the one first base end portion of the one first arm portion of the click feeling forming arm is integrally formed with the base portion at one side of the base portion, wherein the press arm includes other second engaging projected portion at a side edge of the projected end portion of the pressing projected portion on a side opposed to the side edge of the projected end portion of the pressing projected portion at which the one second engaging projected portion is present, and wherein the click feeling forming arm includes other first elastic arm portion extended from other first base end portion formed integrally with the other side of the base portion and capable of being deformed to bend elastically, and other first engaging projected portion projected to the one first engaging projected portion at a side portion of a first front end portion of the other first elastic arm portion opposed to the one first engaging projected portion of the one first elastic arm portion and engageable with and disengageable from the other second engaging projected portion.

In this case, the click feeling forming arms are engaged with the second engaging projected portions of the both side edges of the pressing projected portion of the press arm, and therefore not only guiding of the pressing projected portion is stabilized but also the click feeling can be provided firmly by the both sides. Further, although in this case, timings of engagement and disengagement of both sides (that is, one and other) first and second engaging projected portions are selected to stay the same actually, when desired, two stages of click feelings may be provided by intentionally shifting the timings of engagement and disengagement.

According to the spring structure for the press type switch of the invention, typically, the click feeling forming arm and the press arm are provided with shapes in mirror symmetry with regard to a center line connecting the base portion and the pressing projected portion.

In this case, an influence of a component in a lateral direction of an external force (component in a direction orthogonal to a mirror symmetry line) can be minimized, and therefore, the operation of the spring structure for the press type switch is easy to be stabilized.

According to the spring structure for the press type switch of the invention, typically, the base portion includes a fixing portion extended in a direction of being proximate to the pressing projected portion between the one and the other first elastic arm portions.

In this case, the base portion is easy to be fixedly supported stably. Further, when desired, the fixing portion may be provided with a butting face (lock face) for rectifying a maximum projection amount of the pressing projected portion.

According to the spring structure for the press type switch of the invention, typically, a total thereof comprises a plane structure in a plate-like shape. Therefore, as described above, high accuracy fabrication or working is easy to be carried out. However, when desired, by making a thickness thereof differ by portions thereof, an elastic force of a desired magnitude may be provided at a desired portion, or a projected portion or a recessed portion in a thickness direction may be utilized in relation to other part.

According to the spring structure for the press type switch of the invention, typically, the base portion is constituted to be positioned to be fixed to a main plate of the electronic timepiece. That is, the stationary supporter is constituted by the main plate of the electronic timepiece. Thereby, the spring structure for the press type switch can stably and solidly be supported. Further, the stationary supporter may be other, comparatively large-sized and comparatively thick support member which is normally referred to by other name of a train wheel bridge or an N-th bridge (N is a numeral) or the like in place of the main plate.

In order to achieve the above-described object, typically, a press type switch of an electronic timepiece of the invention includes the spring structure for the press type switch, and a switch plate ensuring conduction with a contact when the second engaging projected portion of the press arm is engaged with and disengaged from the first engaging projected portion of the click feeling forming arm by pressing a side face of the press arm of the spring structure on a side opposed to the pressing projected portion.

In this case, not only the above-described advantage is achieved but also by only pressing the switch plate by the press button, ON/OFF operation of the switch and the click feeling are actually provided simultaneously. Further, typically, the switch plate and the spring structure are formed such that the engaging projected portions are engaged and released in order to provide the click feeling after conduction between the contacts accompanied by pressing the switch plate. However, the both may simultaneously be brought about, or the conduction between the conducts is brought about after providing the click feeling. In either of cases of before and after providing the click feeling, the switch is constituted to reduce a shift therebetween in the series of operation.

Further, when desired, instead of pressing the switch plate by the press button and pressing the spring structure by the switch plate, the press button may directly press the press arm of the spring structure for the press type switch and the switch plate may be displaced in accordance with deforming the press arm.

In order to achieve the above-described aspct, an electronic timepiece of the invention includes the above-described spring structure for the press type switch and includes the above-described press type switch, thereby, the above-described advantage is achieved.

BRIEF DESCRIPTION OF THE DRAWINGS

FIG. 2A is a plane (upper face of FIG. 2B) explanatory view of a portion of the electronic timepiece, FIG. 2B is a side explanatory view in an arrow mark IIB direction of FIG. 2A, and FIG. 2C is a sectional explanatory view taken along a line IIC-IIC of FIG. 2B.

FIG. 3A is an explanatory view similar to FIG. 2B in an initial state and an explanatory view in an arrow mark IIA direction of FIG. 3B, FIG. 3B is an explanatory view similar to FIG. 3A with regard to a state in which an engaging projected portion of a pressing projected portion is brought into contact with an engaging projected portion of an elastic arm portion of a click feeling forming arm.

FIG. 4A is an explanatory view similar to FIG. 3A with regard to a state of making a contact ON, FIG. 4B is an explanatory view similar to FIG. 4A with regard to a state in which the engaging projected portion of the pressing projected portion passes through an interval between the engaging projected portions of the elastic arm portions of the click feeling forming arm.

DESCRIPTION OF THE PREFERRED EMBODIMENTS

An explanation will be given of a preferable embodiment of the invention based on a preferable example shown in the attached drawings.

EXAMPLE

Figure 1:
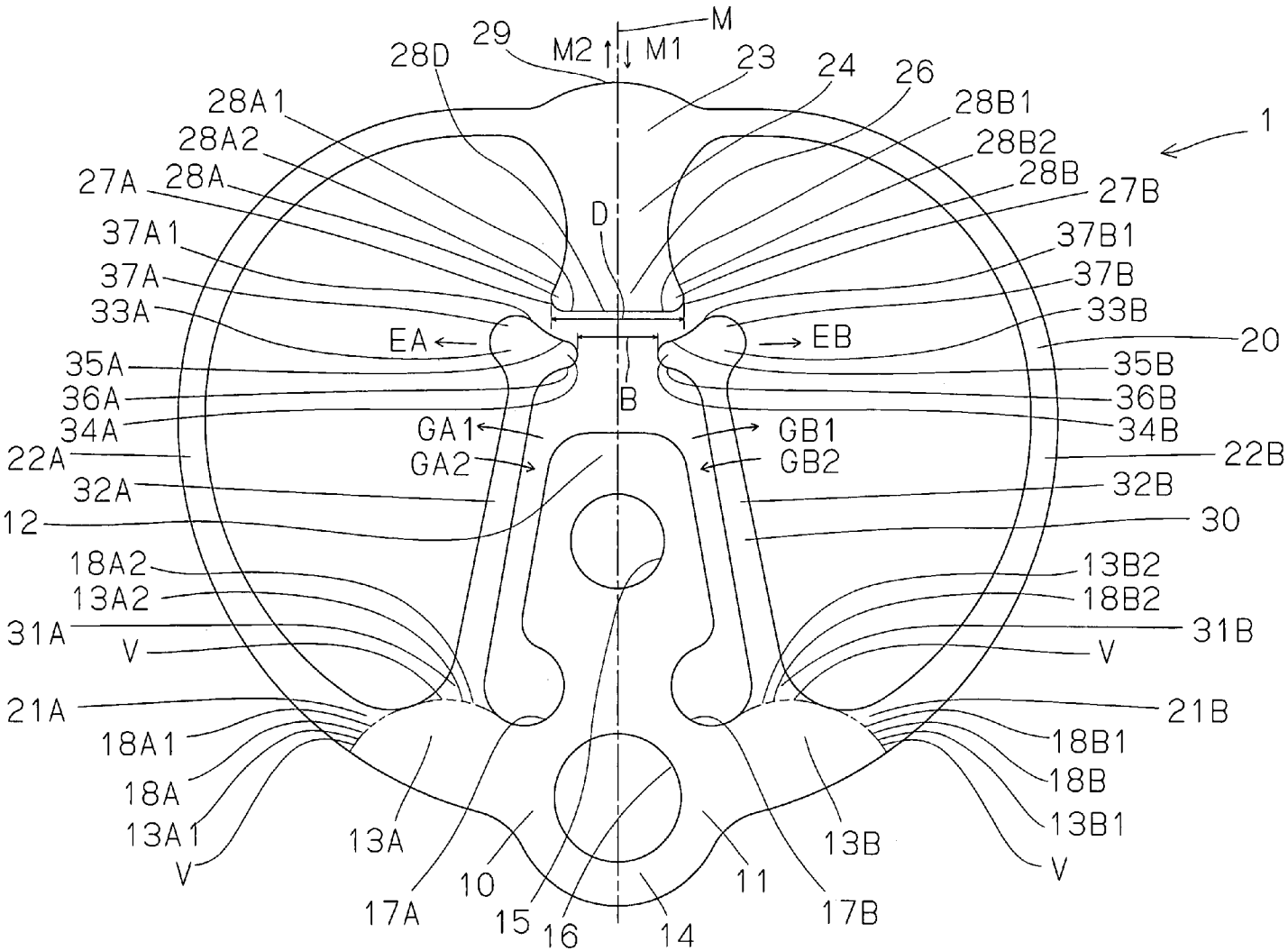
FIG. 1 is a front explanatory view of a spring structure for a press type switch of an electronic timepiece according to a preferable embodiment of the invention.
Figure 2A:
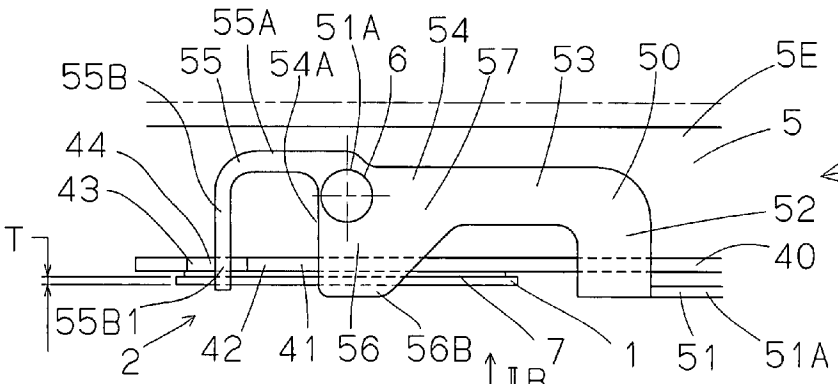
FIGS. 2A, 2B and 2C show a portion of an electronic timepiece of a preferable example of the invention having a press type switch of a preferable example of the invention including the spring structure of FIG. 1.
Figure 2C:
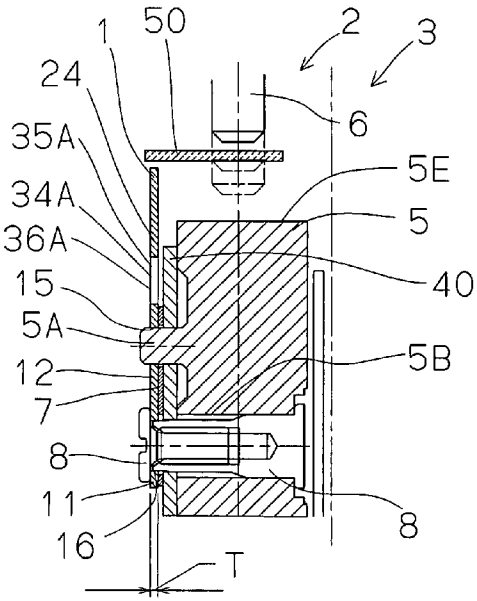
Figure 2B:
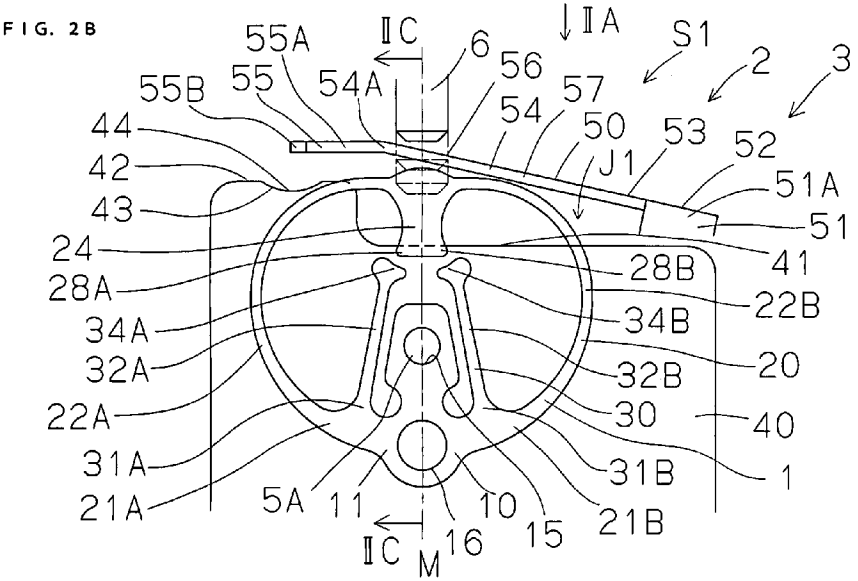

FIG. 1 shows a spring structure 1 for a press type switch, and FIGS. 2A through 2C show a portion of an electronic timepiece 3 having a press type switch 2 including the spring structure 1 of FIG. 1.

As is known from an enlarged view of FIG. 1, the spring structure 1 for the press type switch 2 of the electronic timepiece 3 includes a base portion 10 for fixing the spring structure 1 by a stationary supporter such as a main plate 5 of the electronic timepiece 3 (refer to FIG. 2C) to thereby support the spring structure 1, a press arm 20 deformed to be displaced in accordance with pressing by a press button 6 (refer to FIGS. 2A through 2C) integrally formed with the base portion 10, and a click feeling forming arm 30 integrally formed with the base portion 10 for providing a click feeling when a deformation and displacement of the press arm 20 in accordance with pressing by the press button reaches a predetermined state, and is provided with a mirror symmetry shape in a left and right direction with regard to a center line M. Further, the spring structure 1 for the press type switch comprises a thin plate having a constant thickness T (refer to FIGS. 2A and 2*c*) according to the example and fabricated typically by MEMS.

The base portion 10 includes a base portion main body portion 11 disposed along the center line M. The base portion main body portion 11 includes a center projected portion 12 as a fixed portion extended inwardly along the center line M, that is, in an M2 direction, a pair of side projected portions 13A and 13B extended to both sides of the center line M, and a small projected portion or a fat portion 14 projected outwardly along the center line M, that is, in an M1 direction. An end face of the center projected portion 12 in M2 direction (upper end face in FIG. 1) may constitute a butting face (lock face) for rectifying a maximum projected amount in M1 direction of a pressing projected portion 24 mentioned later. A portion of the base portion main body portion 11 including the center projected portion 12 and the fat portion 14 is formed with a small diameter hole portion 15 for positioning and a large diameter hole portion 16 for fixing. Further, the base portion main body portion 11 includes a pair of notched portions 17A and 17B between respectives of the pair of side projected portions 13A and 13B and the center projected portion 12. The notched portions 17A and 17B are smoothly bent in order to avoid stress concentration to base end portions thereof when elastic arm portions 32A and 32B of the click feeling forming arm 30 mentioned later are bent.

In the above-described, although a boundary or an outer edge of the base portion 10 is not needed to be rectified strictly, in this specification, for convenience, the base portion 10 is regarded by a portion which is not substantially deformed in deforming the press arm 20 and the click feeling forming arm 30. As a rough boundary which is not strict but is easy to see, in FIG. 1, an imaginary boundary V is indicated by an imaginary line. However, the outer edge of the base portion 10, that is, the boundary between the base portion 10 and the base arm 20 and the click feeling forming arm 30 needs not to be rectified strictly but a portion more or less deformed in deforming the press arm 20 and the click feeling forming arm 30 may be included in the base portion 10, or conversely, a portion of the portion which is not substantially deformed may be included in the press arm 20 and the click feeling forming arm 30 (the base portion 10 may constitute a portion of the portion which is not substantially deformed in deforming the press arm 20 and the click feeling forming arm 30).

Further, so far as the base portion 10 is positioned to be fixed by the two hole portions 15 and 16, a shape thereof and arrangements of the hole portions may differ from those illustrated. For example, when an occupy space (typically, a thickness of the electronic timepiece) is permitted to be larger, when desired, in place of projecting the center projected portion 12 in the M2 direction, the center projected portion 12 may be projected in the M1 direction, or so far as the two hole portions 15 and 16 are surrounded by peripheral walls of sufficient sizes which are difficult to be deformed, the center projected portion 12 may be dispensed with; or a plurality of projected portions may be formed at positions shifted from a center or the center line M.

The press arm 20 includes a pair of elastic arm portions 22A, 22B as one and other second elastic arm portion integrally connected to base end portions 21A and 21B to bend to extend in an arc-like shape, and a pressing projected portion 24 formed at a common extended end 23 of the elastic arm portions 22A and 22B and extended in the M1 direction to a side of the base portion 10 along the center line M at front end portions 13A1 and 13B1 of both side edges 18A and 18B of the main body portion 11 of the base portion 10, that is, at front end portions 13A1 and 13B1 of the side projected portions 13A and 13B. Further, the projected portion 24 includes a fat or bulged portion 29 projected to bulge slightly in the M2 direction at a base end 24C. The fat portion 29 is a portion of receiving a press force in the M1 direction by a switch plate 50 in accordance with pressing of the press button 6 mentioned later.

The projected portion 24 includes a pair of engaging projected portions 28A and 28B as one and other second engaging projected portion at both side edges 27A and 27B of an extended end or a front end portion 26 in the M1 direction. In this example, side edge portions 28A1 and 28B1 in the M1 direction of the engaging projected portions 28A and 28B constitute one linear line 28D orthogonal to the center line M, and side edge portions 28A2 and 28B2 on opposed sides are respectively bent in an arc-like shape concave to outside. However, so far as a stroke in the M1 direction of the projected portion 24 is ensured and the click feeling is provided firmly, the side edge portions 28A1 and 28B1 may be constituted by a shape to be convex in the M1 direction as a whole.

Further, the pressing projected portion 24 may be constituted by any other shape so far as, as explained below, when the pressing projected portion 24 is pressed between one and other first engaging projected portion of the click feeling forming arm 30 in correspondence therewith and passed in the M1 or M2 direction between the first engaging projected portions, the pressing projected portion 24 is engaged with the corresponding first engaging projected portions to be able to press away the first engaging projected portions against elastic forces of the elastic arm portions of the click feeling forming arm 30 and engagement with the corresponding first engaging projected portions can be released by passing therethrough.

The click feeling forming arm 30 includes a pair of elastic arm portions or the elastic lever portions 32A and 32B as one and other first elastic arm portion connected integrally to inner side portions 18A2 and 18B2, that is, inner side edge portions 13A2 and 13B2 of the side projected portions 13A and 13B in the both side edges 18A and 18B of the main body portion 11 of the base portion 10 to be inclined in M2 direction to the front end portion 26 of the pressing projected portion 24 of the press arm 20 and in directions of being proximate to the center line M as a path of displacing the pressing projected portion 24. The elastic arm portions 32A and 32B can be made to be deformed or pivoted elastically in GA1 and GA2 directions and GB1 and GB2 directions with regard to the corresponding connecting portions 13A, 13B of the base portion main body portion 11, respectively. The elastic arm portions 32A and 32B include engaging projected portions 34A and 34B as one and other first engaging projected portion projected to the center line M at front end portions 33A and 33B. An interval B between the engaging projected portions 34A and 34B is smaller than a width D of a front end portion of the pressing projected portion 24, that is, a width D between front ends of the engaging projected portions 28A and 28B of the pressing projected portion 24 (refer to FIG. 1).

The engaging projected portions 34A and 34B include side faces 35A and 35B inclined such that the more proximate to the center line M the portions more disposed in the M1 direction to receive forces in directions of being escaped in lateral directions EA and EB by the side edge portions 28A1 and 28B1 in the M1 direction by being engaged with the side edge portions 28A1 and 28B1 in the M1 direction of the pressing projected portion 24 when the pressing projected portion 24 is displaced or moved in the M1 direction at side edges on the M2 side. Further, the side faces 35A and 35B constitute comparatively large angles relative to the M1 direction to provide a sufficient resistance against a displacement of the pressing projected portion 24 in the M1 direction to firmly provide the click feeling by engaging and releasing. The elastic arm portions 32A and 32B of the click feeling forming arm 30 are inclined to be remote from each other as being remote in the M1 direction from the engaging projected portions 34A and 34B, and therefore, when the engaging projected portions 28A and 28B of the pressing projected portion 24 are displaced in the M1 direction by exceeding the engaging projected portions 34A and 34B, the engagement between the engaging projected portions 28A and 28B of the pressing projected portion 24 and the engaging projected portions 34A and 34B of the click feeling forming arm 30 are firmly released and there is not a concern that the engaging projected portions 28A and 28B of the pressing projected portion 24 and the arm portions 32A and 32B of the click feeling forming arm 30 interfere with each other.

The engaging projected portions 34A and 34B include side faces 36A and 36B inclined such that the more proximate the portion the center line M, the more disposed in the M2 direction to receive forces in the direction of being escaped in the lateral directions EA and EB by the side edge portions 28A2 and 28B2 by being engaged with the side edges portions 28A2 and 28B2 of the pressing projected portion 24 when the engaging projected portions 28A and 28B of the pressing projected portion 24 displaced in the M1 direction return in the M2 direction temporarily by exceeding the engaging projected portions 34A and 34B at side edges thereof on the M1 side. The pressing projected portion 24 returns in the M2 direction by elastic recovery forces of the elastic arm portions 22A and 22B of the pressing arm 20, and therefore, the side edges portions 28A2 and 28B2 and the side faces 36A and 36B are extended in the M2 direction by comparatively small angles in order to minimize a resistance in returning.

The click feeling forming arm 30 includes bulged portions or projected portions 37A and 37B at respective back sides of the engaging projected portions 34A and 34B. The projected portions 37A and 37B include inclined faces 37A1 and 37B1 continuously connected to side faces 35A and 35B of the engaging projected portions 34A and 34B and disposed such that the more remote from the center line M, the more disposed in the M2 direction at side edges thereof on the M2 side. The inclined faces 37A1 and 37B1 firmly guide the projected portion 24 in the M1 direction when the pressing projected portion 24 is displaced in the M1 direction even in a case of being shifted more or less laterally (that is, in direction orthogonal to the center line M).

The spring structure 1 having the above-described constitution is integrated to the main plate 5 to form the press type switch 2 as shown by FIGS. 2A through 2C.

That is, according to the press type switch 2, as is known from FIGS. 2A through 2C, the spring structure 1 is attached to the main plate 5 by way of a circuit board 40 and an electrically insulating thin plate 7.

Further in details, as is known from FIG. 2C, the spring structure 1 is positioned to be fixed to the main plate 5 by being fitted to a pin-like projected portion 5A formed at the main plate 5 by the small diameter hole portion 15 along with the circuit board 40 and the electrically insulating thin plate 7 and being fixed to a hole portion 5B of the main plate 5 along with the circuit board 40 and the electrically insulating thin plate 7 by fixing means 8. According to the example, the fixing means 8 comprises a bolt and a nut. Thereby, the spring structure 1 is fixed such that the base portion 10 stays to be unmoved relative to the main plate 5. Further, in FIG. 2B, the fixing means 8 is omitted. The fixing means 8 may be constituted by any other means so far as the base portion 10 or the like of the spring structure 1 can be maintained to be unmoved relative to the main plate 5.

The circuit board 40 includes a stepped portion 42 at an outer peripheral side edge portion or an outer peripheral face 41 and includes a contact 44 at a recess portion 43 of the stepped portion 42.

A switch terminal 50 is extended on an outer peripheral side of the circuit board 40 of the electronic timepiece 3. The switch terminal 50 typically constitutes a part of a plate-like member (hereinafter, also referred to as battery plus terminal plate) 51 constituting a battery plus terminal. Further, a main body portion 51A of the battery plus terminal plate 51 is expanded in a plate-like shape in parallel with a main face of the electronic timepiece 3 to provide a potential of a plus electrode of a battery (not illustrated) to various electric and electronic parts of the electronic timepiece 3.

The switch terminal 50 includes a base end portion 52 folded to bend orthogonally to the battery plus terminal main body portion 51A and extended in a thickness direction H of the battery, a plate spring shape arm portion 53 extended from the base end portion 52 along an outer side face 5E of the main plate 5, a press force transmitting portion 54 having a wide width continuously formed to a front end side of the arm portion 53, and a contact arm portion 55 slightly folded to bend relative to a front end 54A of the press force transmitting portion 54 and extended in an L-like shape from the front end 54A. A base end side leg portion 55A of L of the L-like contact arm portion 55 is extended in a peripheral direction of the main plate 5 along the outer peripheral face 5E of the main plate 5, a front end side leg portion 55B of L is extended in a thickness direction (thickness direction of electronic timepiece 3) H of the main plate 5, and an extended end portion operated as a contact 55B1 is disposed at a position of being proximate to be opposed to the contact portion 44 of the circuit board 40. The press force transmitting portion 54 includes a press force transmitting main body portion 56 which is provided with a width far wider than the plate spring shape arm portion 53 and extended in a width direction (thickness direction of electronic timepiece 3) H to reach a location of being opposed to the bulged portion 29 on the back side of the pressing projected portion 24 of the spring structure 1, and a transition portion 57 in a trapezoidal shape connecting the main body portion 56 and the arm portion 53. Although in this example, the press force transmitting main body portion 56 and the transition portion 57 are regarded not to be deformed actually, these may be elastically deformed to some degree.

Further, as is known from FIG. 2B, the plate spring shape arm portion 53 of the switch terminal 50 is inclined to the direction orthogonal to the direction of extending the center line M of the spring structure 1 from the base end portion 52 to the press force transmitting main body portion 56 in a state S1 in which a press force is not exerted to the switch terminal 50. Further, in the state S1, the L-like contact arm portion 55 is disposed within a face substantially orthogonal to the direction of extending the center line M of the spring structure 1.

According to the press type switch 2, roughly speaking, when the press button 6 mounted to a case (not illustrated) of the electronic timepiece 3 is pressed in the M1 direction, the press button 6 presses a press force receiving portion 56A of the main body portion 56 of the press force transmitting portion 54 of the switch terminal 50 opposed to the button 6 in the M1 direction, the plate spring shape arm portion 53 of the switch terminal 50 is bent in J1 direction, a spring structure pressing portion 56B of the main body portion 56 of the press force transmitting portion 54 of the switch terminal 50 opposed to the bulged portion 29 on the back side of the pressing projected portion 24 of the spring structure 1 is pressed in the M1 direction and the contact 55B1 of the contact arm portion 55 at the front end of the switch terminal 50 is pressed to the contact portion 44 of the circuit board 40.

Next, an operation of the press type switch 2 including the spring structure 1 constituted as described above will be explained further in details in reference to FIGS. 3A through 3B and FIGS. 4A through 4B.

Figure 3A:
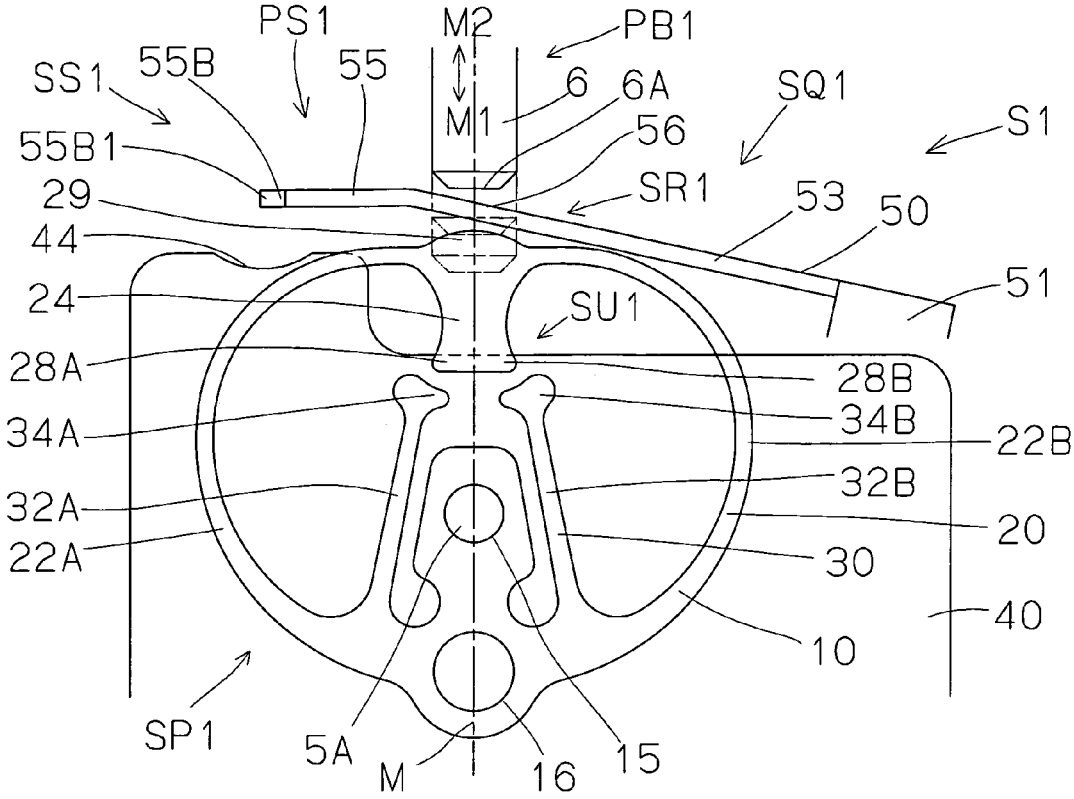
FIGS. 3A and 3B show a portion of a state of operating the press type switch of FIGS. 2A, 2B and 2C or an operating state thereof.

FIG. 3A shows a state the same as a state shown in FIGS. 2A through 2C in the state S1 before the press type switch 2 is pressed in which the press button 6 is disposed at an initial position (projected portion) PB1 displaced in the M2 direction.

In the state S1, the spring structure 1 is brought into a nondeformed state SP1 before being deformed and the switch terminal 50 is disposed at an initial position SQ1 at which the plate spring shape arm portion 53 is extended in a skewed direction. In the nondeformed state SP1 of the spring structure 1, the engaging projected portions 28A and 28B of the pressing projected portion 24 adopt an initial position (remote position) SU1 of being remote in the M2 direction relative to the engaging projected portions 34A and 34B of the elastic arm portions 32A and 32B of the click feeling forming arm 30. However, when desired, the engaging projected portions 28A and 28B of the pressing projected portion 24 and the engaging projected portions 34A and 34B of the elastic arm portions 32A and 32B of the click feeling forming arm 30 may be proximate to each other in M1 or M2 direction to a degree of being brought into contact with each other actually or brought into contact with each other substantially.

Further, in the state in which the switch terminal 50 is disposed at the initial position SQ1, the plate spring shape arm portion 53 of the switch terminal 50 is disposed at a position SR1 which the press force transmitting portion 54 is loosely fitted between the press button 6 disposed at the initial position PB1 and the bulged portion 29 of the spring structure 1, and the contact arm portion 55 is disposed at a position of being remote from the contact portion 44 of the circuit board 40 to adopt an OFF state SS1. Further, at the initial position SQ1 of the switch terminal 50, the portion 56A of the main body portion 56 of the press force transmitting portion 54 may be brought into contact with an inner side end portion 6A of the press button 6.

Figure 3B:
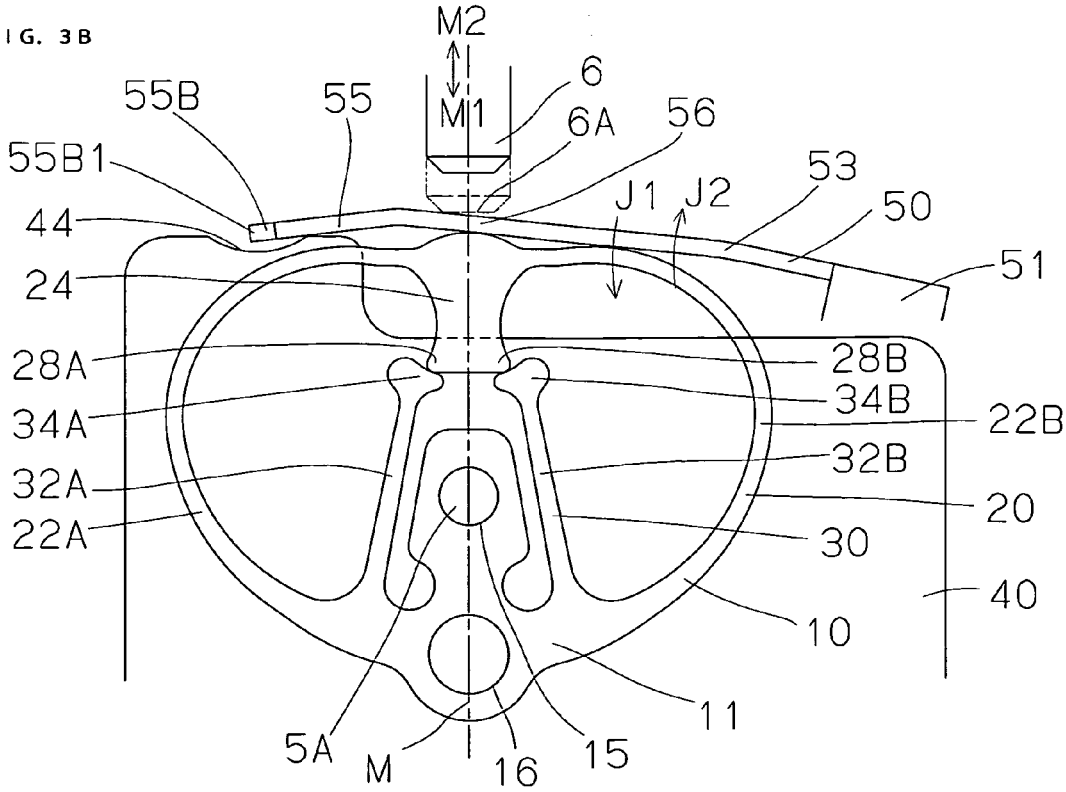

When the press button 6 is pressed from the initial position PB1 in the M1 direction, as shown by FIG. 3B, the inner end 6A of the press button 6 presses the press force receiving portion 56A of the main body portion 56 of the press force transmitting portion 54 of the switch terminal 50 in the M1 direction to displace the press force transmitting main body portion 56 in the M1 direction. In accordance with the displacement of the press force transmitting main body portion 56 in the M1 direction, the spring structure pressing portion 56B of the main body portion 56 presses the bulged portion 29 of the spring structure 1 in the M1 direction to bend the elastic arm portions 22A and 22B of the press arm 20 of the spring structure 1, and the pressing projected portion 24 of the spring structure 1 is displaced in the M1 direction. Thereby, the engaging projected portions 28A and 28B of the pressing projected portion 24 start to be brought into contact to be engaged with the engaging projected portions 34A and 34B of the front ends of the elastic arm portions 32A and 32B of the click feeling forming arm 30. Further, the spring structure 1 is provided with a shape or a structure in mirror symmetry with regard to the center line M and the pressing projected portion 24 or the bulged portion 29 is supported at both sides thereof by the elastic arm portions 22A and 22B constituting the press arm 20, and therefore, the pressing projected portion 24 can actually be displaced in the M1 direction.

On the other hand, the plate spring shape arm portion 53 of the switch terminal 50 is bent in J1 direction in accordance with pressing by the press force transmitting portion 54 of the switch terminal 50 in M1 direction, and the extended end (contact) 55B1 of the L-like contact arm portion 55 disposed at the front end of the switch terminal 50 is made to be proximate to the contact portion 44 of the circuit board 40.

Figure 4A:
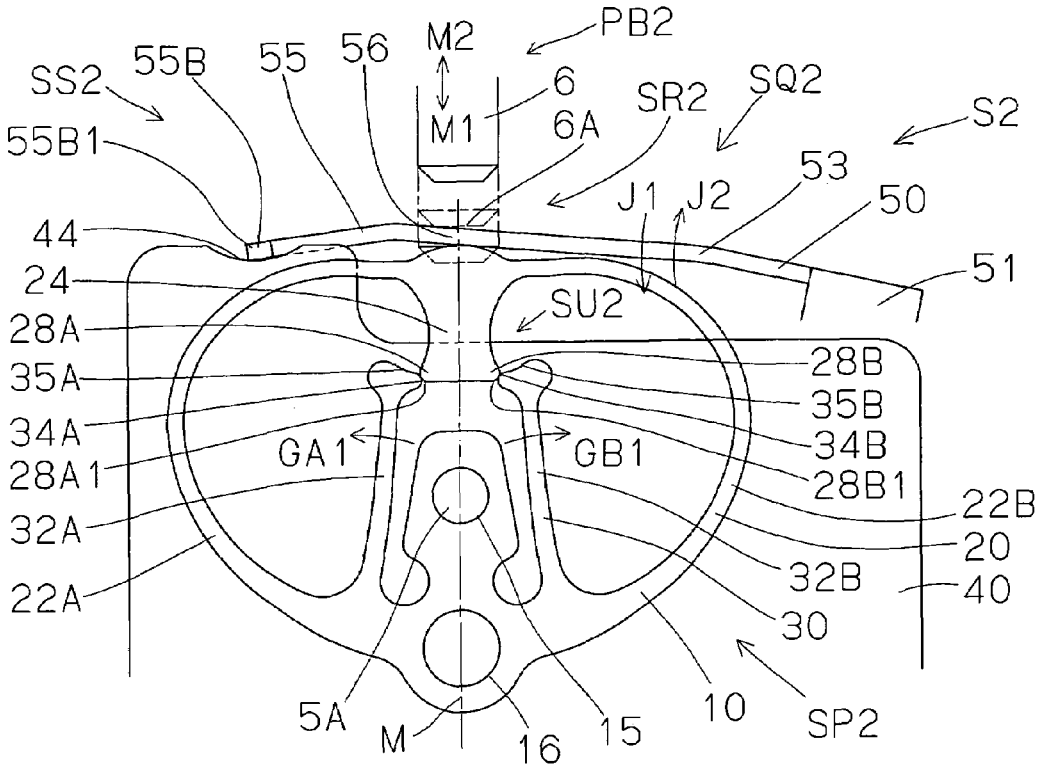
FIGS. 4A and 4B show a remaining portion of the state of operating the press type switch of FIGS. 2A, 2B and 2C or the operating state.

When the press button 6 is pressed further in M1 direction, as shown by FIG. 4A, the press force receiving portion 56A of the main body portion 56 of the press force transmitting portion 54 is set to ON position SS2 at which the contact 55B1 of the contact arm portion 55 of the switch terminal 50 pressed down in M1 direction by the inner end 6A of the press button 6 is brought into contact with the contact 44 disposed at the recess portion 43 of the outer side face 41 of the circuit board 40.

In ON state S2 of the press type switch 2 shown in FIG. 4A, the press button 6 adopts ON position PB2, the switch terminal 50 adopts one stage deformed position SQ2, and the spring structure 1 adopts one stage deformed state SP2. In the one stage deformed state SP2 of the spring structure 1, the engaging projected portions 28A and 28B of the pressing projected portion 24 adopts a one stage pressing position SU2 at which the elastic arm portions 32A and 32B of the click feeling forming arm 30 are bent in GA1 and GB1 directions to be fitted to vicinities of inner ends of the inclined side faces 35A and 35B of the engaging projected portions 34A and 34B of the elastic arm portions 32A and 32B, and the press force transmitting portion 54 adopts one stage pressing position SR2 of being pressed in M1 direction by the press button 6 and pressing the bulged portion 29 and the pressing projected portion 24 of the spring structure 1 in M1 direction.

The pressing projected portion 24 is pressed along the inclined side faces 35A and 35B of the elastic arm portions 32A and 32B of the spring structure 1 by the inner side edge portions 28A1 and 28B1 of the engaging projected portions 28A and 28B from the state of FIG. 3B to reach the state of FIG. 4A, and therefore, the pressing projected portion 24 receives a comparatively large resistance force or a load from the elastic arm portions 32A and 32B. That is, the press type switch 2 adopts ON state S2 in which the contacts 55B1 and 44 are brought into contact state SS2 in receiving a comparatively large resistance force when a user presses the button 6 in M1 direction.

Figure 4B:
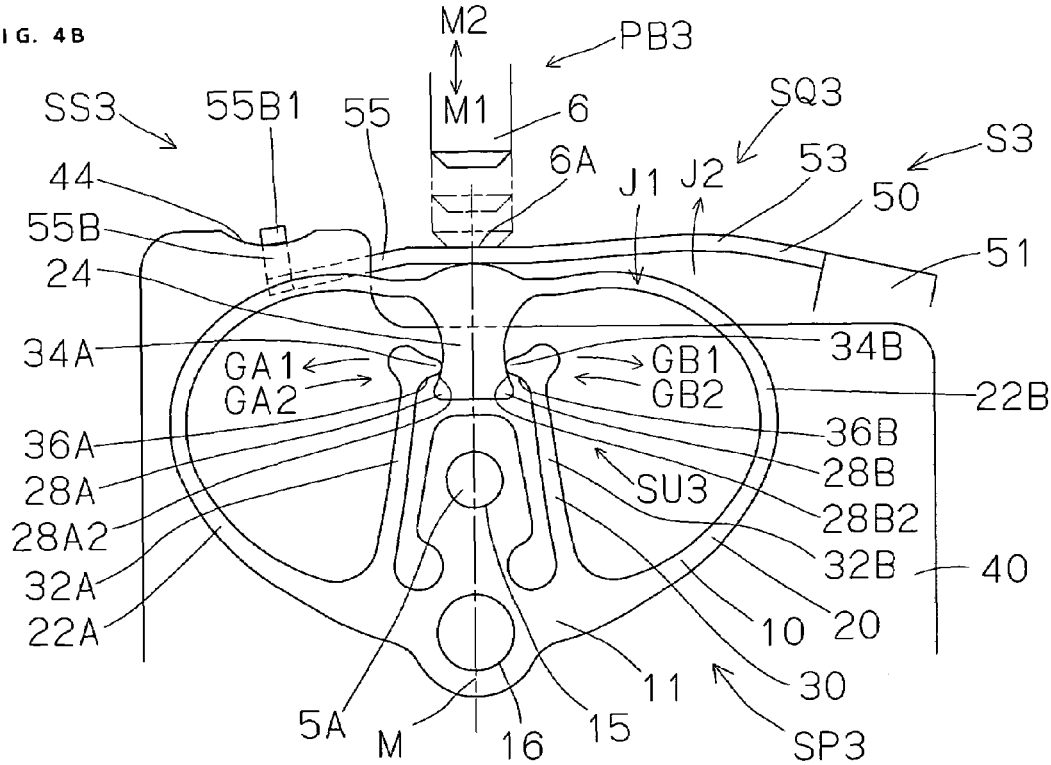

When the press button 6 is pressed further in M1 direction from the state S2, the engaging projected portions 28A and 28B of the pressing projected portion 24 are pressed to between the engaging projected portions 34A and 34B of the elastic arm portions 32A and 32B by only slightly bending the elastic arm portions 32A and 32B further in GA1 and GB1 directions, pass through the interval between the engaging projected portions 34A and 34B in M1 direction to release the engagement with the engaging projected portions 34A and 34B. At side edges 28A2 and 28B2 of the pressing projected portion 24, the more on the base end side, the narrower the width of the projected portion 24, and therefore, the pressing projected portion 24 is immediately pressed in M1 direction without receiving resistances of the elastic arm portions 32A and 32B, and the engaging projected portions 28A and 28B of the pressing projected portion 24 adopt final pressing position SU3 of being fitted to between the elastic arm portions 32A and 32B (FIG. 4B). A rapid reduction in the resistance force when the spring structure 1 proceeds from the state SP2 of FIG. 4A to final pressing state SP3 shown in FIG. 4B is sensed as a click feeling for a user of pressing the press button 6.

On the other hand, in accordance with further pressing the press button 6 in M1 direction, the press button 6 reaches a final pressing position PB3 (for example, a position at which an outer side end portion of the press button 6 is actually flushed with an outer peripheral face of a timepiece case (not illustrated)) and the switch terminal 50 adopts a final pressing state SQ3 shown in FIG. 4B. At the final pressing state SQ3 of the switch terminal 50, the L-like contact arm portion 55 of the switch terminal 50 adapts a final portion SS3 of being bent relatively in MZ direction in a state in which the base and side leg portion 55A is pressed in M1 direction on the backside of the stepped portion 42 of the circuit board 40, and therefore, the front end contact portion 55B1 is brought into contact with the contact 44 of the circuit board 40. Further, at the final position SS3, typically, electric contact of the contact portion 55B1 and the contact 44 is cut. Here, there may be constructed a circuit constitution of positively utilizing that the electric contact (conduction) temporarily cut is produced again in a procedure of returning the switch terminal 50 in J2 direction, or a circuit constitution of being insensitive to conduction in the return procedure in place thereof. However, the contact portion 55B1 and the contact 44 may be formed by shapes of maintaining conduction between the contact portion 55B1 and the contact 44.

As described above, the press type switch 2 is brought into the final pressing state S3 in FIG. 4B.

According to the press type switch 2, there is brought about the state S3 of providing the click feeling immediately after bringing about the state S2 of setting the interval between the contacts 55B1 and 44 to the ON state, and therefore, it can firmly be sensed that the ON state is brought about. Further, according to the press type switch 2, when there is brought about the click feeling, the interval between the contacts 55B1 and 44 has already been brought into the ON state, and therefore, in comparison with a case of bringing about the ON state after providing the click feeling, there is not a concern of stopping to press the press button 6 erroneously. However, when desired, lengths of the pressing projected portion 24 and the elastic arm portions 32A and 32B may be set such that a timing of producing the click feeling and closing the contacts 55B1 and 44 are actually brought about simultaneously, or, the lengths of the pressing projected portion 24 and the elastic arm portions 32A and 32B may be set such that the contacts 55B1 and 44 are closed after providing the click feeling (however, a lag thereof is small).

When the press button 6 is detached, a coil spring (not illustrated) integrated to the timepiece case presses back the press button 6. Further, the switch terminal 50 returns to an original position by returning the plate spring shape arm portion 53 in J2 direction by the elastic force of the plate spring shape arm portion 53.

On the other hand, according to the spring structure 1, a recovery force of returning the elastic arm portions 22A and 22B of the press arm 20 from the bent state to the original state is exerted to the pressing projected portion 24, and therefore, the engaging projected portions 28A and 28B of the pressing projected portion 24 bend the elastic arm portions 32A and 32B of the click feeling forming arm 30 in GA1 direction and pass through the interval between the engaging projected portions 34A and 34B of the elastic arm portions 32A and 32B to be displaced in M2 direction to return to the original positions. As a result, also the spring structure 1 returns to an initial state SP1 shown in FIG. 3A.

Further, when the engaging projected portions 28A and 28B of the pressing projected portion 24 are displaced in M2 direction relative to the elastic arm portions 32A and 32B of the click feeling forming arm 30, the engaging projected portions 28A and 28B are displaced along the inclined side edges 36A and 36B of the engaging projected portions of the elastic arm portions 32A and 32B at the gradually inclined side edges 28A2 and 28B2, and therefore, the displacement in M2 direction can easily be carried out.

Although in the above-described, an explanation has been given of the example in which the press arm 20 includes the pair of elastic arm portions 22A and 22B, depending on cases, the press arm 20 may be constituted by one of, that is, the one second elastic arm portions 22A or 22B. Further, although in the above-described, an explanation has been given of the example in which the click feeling forming arm 30 includes the pair of elastic arm portions 32A and 32B, depending on cases, the click feeling forming arm 30 may be constituted by one of, that is, the one first elastic arm portions 32A or 32B.

What is claimed is:

1. A spring structure for a press type switch of an electronic timepiece which is a spring structure for a press type switch of an electronic timepiece, the spring structure comprising:

a base portion fixed to a stationary supporter of the electronic timepiece;

a click feeling forming arm including one first elastic arm portion extended from one first base end portion formed integrally with the base portion and capable of being deformed to bend elastically and one first engaging projected portion formed on one side of a first front end portion of the first elastic arm portion; and a press arm including one second elastic arm portion extended to bend in an arc-like shape from one second base end portion formed integrally with the base portion and capable of being deformed to bend, a pressing projected portion projected to the first front end portion at a position of the one second elastic arm portion opposed to the first front end portion of the one first elastic arm portion of the click feeling forming arm and one second engaging projected portion engageable with and disengageable from the one first engaging projected portion at a side edge on a side of a projected end portion of the pressing projected portion opposed to the one first engaging projected portion of the click feeling forming arm;

wherein when the pressing projected portion of the press arm is pressed, the one second engaging projected portion of the pressing projected portion of the press arm is engaged with the one first engaging projected portion of the click feeling forming arm to elastically bend the one first elastic arm portion by pressing the one first engaging projected portion in a lateral direction, and an engagement with the one first engaging projected portion is constituted to be released by passing a location of the one first engaging projected portion.

2. A spring structure for a press type switch of an electronic timepiece according to claim 1, wherein the one first elastic arm portion of the click feeling forming arm is extended skewedly to a direction of displacing the pressing projected portion of the press arm such that the more on the front side, the more proximate to a path of displacing the pressing projected portion of the press arm.

3. A spring structure for a press type switch of an electronic timepiece according to claim 2, wherein the one second base end portion of the one second arm portion of the press arm is formed integrally with the base portion on one side of the base portion; and wherein the press arm further includes other second elastic arm portion extended to bend in an arc-like shape from other second base end portion integrally formed with other side of the base portion and capable of being deformed to bend, and the other second elastic arm portion is integrally connected to the pressing projected portion at an extended end thereof to thereby support the pressing projected portion elastically at both sides thereof in cooperation with the one second elastic arm portion.

4. A spring structure for a press type switch of an electronic timepiece according to claim 3, wherein the one first base end portion of the one first arm portion of the click feeling forming arm is integrally formed with the base portion at one side of the base portion;

wherein the press arm includes other second engaging projected portion at a side edge of the projected end portion of the pressing projected portion on a side opposed to the side edge of the projected end portion of the pressing projected portion at which the one second engaging projected portion is present; and wherein the click feeling forming arm includes other first elastic arm portion extended from other first base end portion formed integrally with the other side of the base portion and capable of being deformed to bend elastically, and other first engaging projected portion projected to the one first engaging projected portion at a side portion of a first front end portion of the other first elastic arm portion opposed to the one first engaging projected portion of the one first elastic arm portion and engageable with and disengageable from the other second engaging projected portion.

5. A spring structure for a press type switch of an electronic timepiece according to claim 4, wherein the click feeling forming arm and the press arm are provided with shapes in mirror symmetry with regard to a center line connecting the base portion and the pressing projected portion.

6. A spring structure for a press type switch of an electronic timepiece according to claim 4, wherein the base portion includes a fixing portion extended in a direction of being proximate to the pressing projected portion between the one and the other first elastic arm portions.

7. A spring structure for a press type switch of an electronic timepiece according to claim 2, wherein the one first base end portion of the one first arm portion of the click feeling forming arm is integrally formed with the base portion at one side of the base portion;

wherein the press arm includes other second engaging projected portion at a side edge of the projected end portion of the pressing projected portion on a side opposed to the side edge of the projected end portion of the pressing projected portion at which the one second engaging projected portion is present; and wherein the click feeling forming arm includes other first elastic arm portion extended from other first base end portion formed integrally with the other side of the base portion and capable of being deformed to bend elastically, and other first engaging projected portion projected to the one first engaging projected portion at a side portion of a first front end portion of the other first elastic arm portion opposed to the one first engaging projected portion of the one first elastic arm portion and engageable with and disengageable from the other second engaging projected portion.

8. A spring structure for a press type switch of an electronic timepiece according to claim 7, wherein the click feeling forming arm and the press arm are provided with shapes in mirror symmetry with regard to a center line connecting the base portion and the pressing projected portion.

9. A spring structure for a press type switch of an electronic timepiece according to claim 7, wherein the base portion includes a fixing portion extended in a direction of being proximate to the pressing projected portion between the one and the other first elastic arm portions.

10. A spring structure for a press type switch of an electronic timepiece according to claim 1, wherein the one second base end portion of the one second arm portion of the press arm is formed integrally with the base portion on one side of the base portion; and wherein the press arm further includes other second elastic arm portion extended to bend in an arc-like shape from other second base end portion integrally formed with other side of the base portion and capable of being deformed to bend, and the other second elastic arm portion is integrally connected to the pressing projected portion at an extended end thereof to thereby support the pressing projected portion elastically at both sides thereof in cooperation with the one second elastic arm portion.

11. A spring structure for a press type switch of an electronic timepiece according to claim 10, wherein the one first base end portion of the one first arm portion of the click feeling forming arm is integrally formed with the base portion at one side of the base portion;

wherein the press arm includes other second engaging projected portion at a side edge of the projected end portion of the pressing projected portion on a side opposed to the side edge of the projected end portion of the pressing projected portion at which the one second engaging projected portion is present; and wherein the click feeling forming arm includes other first elastic arm portion extended from other first base end portion formed integrally with the other side of the base portion and capable of being deformed to bend elastically, and other first engaging projected portion projected to the one first engaging projected portion at a side portion of a first front end portion of the other first elastic arm portion opposed to the one first engaging projected portion of the one first elastic arm portion and engageable with and disengageable from the other second engaging projected portion.

12. A spring structure for a press type switch of an electronic timepiece according to claim 11 wherein the click feeling forming arm and the press arm are provided with shapes in mirror symmetry with regard to a center line connecting the base portion and the pressing projected portion.

13. A spring structure for a press type switch of an electronic timepiece according to claim 11, wherein the base portion includes a fixing portion extended in a direction of being proximate to the pressing projected portion between the one and the other first elastic arm portions.

14. A spring structure for a press type switch of an electronic timepiece according to claim 1, wherein the one first base end portion of the one first arm portion of the click feeling forming arm is integrally formed with the base portion at one side of the base portion;

wherein the press arm includes other second engaging projected portion at a side edge of the projected end portion of the pressing projected portion on a side opposed to the side edge of the projected end portion of the pressing projected portion at which the one second engaging projected portion is present; and wherein the click feeling forming arm includes other first elastic arm portion extended from other first base end portion formed integrally with the other side of the base portion and capable of being deformed to bend elastically, and other first engaging projected portion projected to the one first engaging projected portion at a side portion of a first front end portion of the other first elastic arm portion opposed to the one first engaging projected portion of the one first elastic arm portion and engageable with and disengageable from the other second engaging projected portion.

15. A spring structure for a press type switch of an electronic timepiece according to claim 14, wherein the click feeling forming arm and the press arm are provided with shapes in mirror symmetry with regard to a center line connecting the base portion and the pressing projected portion.

16. A spring structure for a press type switch of an electronic timepiece according to claim 14, wherein the base portion includes a fixing portion extended in a direction of being proximate to the pressing projected portion between the one and the other first elastic arm portions.

17. A spring structure for a press type switch of an electronic timepiece according to claim 1, wherein a total thereof comprises a plane structure in a plate-like shape.

18. A spring structure for a press type switch of an electronic timepiece according to claim 1, wherein the base portion is constituted to be positioned to be fixed to a main plate of the electronic timepiece.

19. A press type switch of an electronic timepiece comprising the spring structure for the press type switch according to claim 1, and a switch plate ensuring conduction with a contact when the second engaging projected portion of the press arm is engaged with and disengaged from the first engaging projected portion of the click feeling forming arm by pressing a side face of the press arm of the spring structure on a side opposed to the pressing projected portion in accordance with pressing of a press button.

20. An electronic timepiece comprising the spring structure for a press type switch according to claim 1.

* * * * *